United States Patent [19]

Leff et al.

[11] 4,142,634

[45] Mar. 6, 1979

[54] LAYER SEPARATOR FOR A CONTAINER

[75] Inventors: Michael G. Leff, Atlanta; Ronald W. Cobb, Buford, both of Ga.

[73] Assignee: Allied Plastics, Inc., Doraville, Ga.

[21] Appl. No.: 873,229

[22] Filed: Jan. 30, 1978

[51] Int. Cl.[2] ..... B65D 85/676; B65D 85/04; B65D 85/06

[52] U.S. Cl. ..... 206/392; 206/433; 206/516; 220/23.6

[58] Field of Search ..... 206/392, 564, 516, 433; 220/23.6

[56] References Cited

U.S. PATENT DOCUMENTS

| | | | |
|---|---|---|---|
| 2,704,600 | 3/1955 | Despres | 206/392 |
| 3,375,919 | 4/1968 | Schlager et al. | 206/392 |
| 3,949,876 | 4/1976 | Bridges et al. | 220/23.6 |

*Primary Examiner*—William T. Dixson, Jr.
*Attorney, Agent, or Firm*—Newton, Hopkins & Ormsby

[57] ABSTRACT

A separator for supporting stacked layers of items within a container comprising a first plastic section having a honeycomb pattern embossed on its top surface for rigidity and to distribute any applied force equally in all directions and a second plastic section joined to the underside of the first section, the separator being substantially rectangular in shape and having rounded corners to aid in expelling air trapped between successive layers of items.

11 Claims, 4 Drawing Figures

LAYER SEPARATOR FOR A CONTAINER

BACKGROUND OF THE INVENTION

1. Field of the Invention

This invention relates to a support between courses of material in a container and, more particularly, to a layer separator for a container.

2. Description of the Prior Art

In certain applications, yarn is wound on spools which are then placed in corrugated containers for shipment from the manufacturer to the customer. In the past, cardboard separators have been used between layers of those spools. The containers full of yarn spools are manipulated by means of handling machines which grasp opposed sides of the containers and squeeze-lift the containers onto tractor trailers for shipment.

By such handling, some of the cardboard separators invariably become damaged which in turn causes injury to the yarn and the spools, as well as damage to the cartons themselves. Usually, no effort is made to use the cardboard separators more than once, although effort is made within the industry to recycle the cartons.

If the conventional cardboard separators were strengthenend, such as making them thicker, they would then be too heavy and costly. A single sheet of plastic material in place of a cardboard separator would be too flexible if thin and too rigid if thick.

SUMMARY OF THE INVENTION

The above disadvantages of the prior art are overcome by the present invention which comprises two sections of plastic material bonded together to form a separator which is lightweight, yet rigid enough to withstand severe forces and stresses so as to be able to be reusable.

The separator includes a first section of high impact ABS plastic having a thickness ranging from 0.025 to 0.187 inches. A honeycomb pattern is embossed on the top surface of the first section to impart rigidity thereto. The first section engages the bottoms of the spools of yarn and should, therefore, have as flat or uniform a surface as possible. In order to provide that flat or smooth surface but yet have the honeycomb pattern, the depressions in the surface are kept to a minimum by having the interior of each hexagon raised an equidistant amount from the top surface.

The bottom of the separator comprises a second section bonded to the bottom of the first section, the second section being formed of high impact ABS plastic having a thickness ranging from 0.010 inches to 0.125 inches. The second section has a flat underside which engages the tops of the spools within the layers. By means of any commercially available plastic bonding agent, the second section is joined to the first section along the underside of the depressions in the first section which were created as a result of the thermoforming of the hexagons, the depressions being the sides of the hexagons.

For rigidity, the first section has a lip formed about its periphery and comprising a flange which is joined to an outer depending side wall by means of an arcuate portion. The side wall extends beyond the level of the second section to insure that the leading edge of the second section does not damage the wall of the container when it is grasped by the material handling machine. In the first embodiment of the separator, the outer edge of the second section is spaced from the inner surface of the side wall so that the side wall remains resilient and is able to give inwardly when pressure is applied by the arms of the material handling machine. A second embodiment of the separator has the edge of the second section in engagement with the inner surface of the depending side wall so as to provide a rigid point of contact with the lifting arms of the machine.

The edges of the separator are rounded to allow air trapped between the layers to escape as a separator is being put in place within the container.

It is, therefore, a primary object of the present invention to provide a separator between layers of items within a container which substantially reduces the damage to the items as well as the container during handling and shipping.

Another object of the present invention is to provide a layer separator for a container which is reusable and the cost per use of which does not exceed the cost per use of a conventional cardboard separator.

A further object of the present invention is to provide a layer separator for a container whereby the usable life of the container is extended.

Another object of the present invention is to provide a layer separator for a container which is resistant to moisture and which is able to be easily cleaned.

DESCRIPTION OF THE PREFERRED EMBODIMENTS

Figure 1:
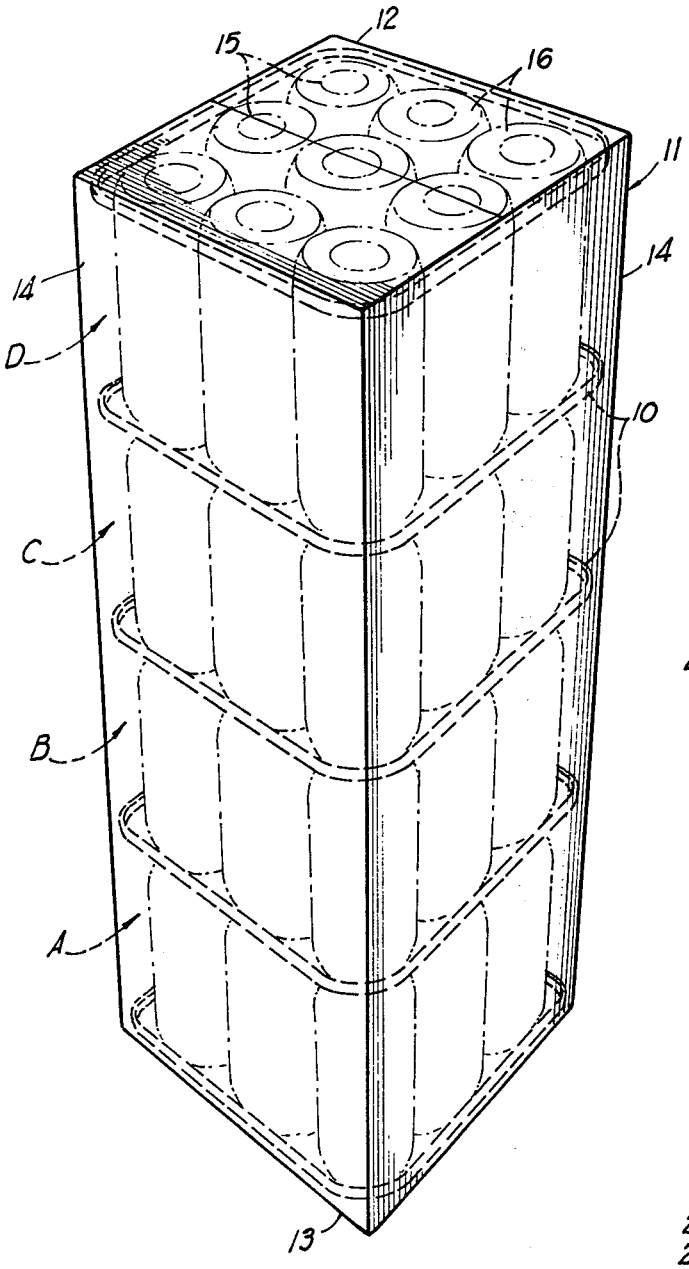
FIG. 1 is a perspective view of a container with layers of spools of yarn being supported by the present invention shown in phantom lines.
Figure 2:
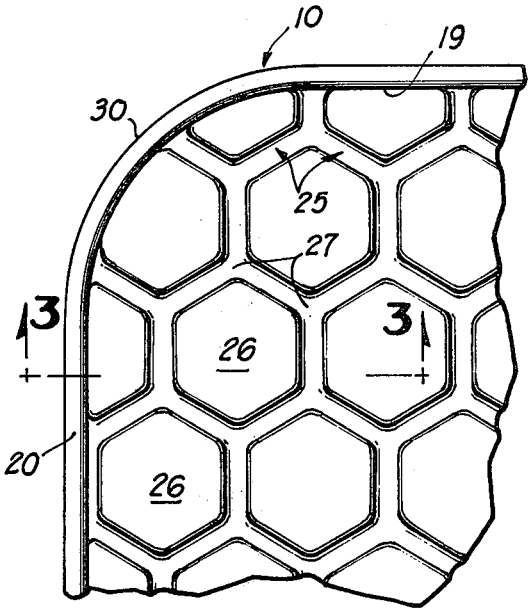
FIG. 2 is a detailed top plan view of a section of the present invention.

Referring to the figures of the drawing, the numeral 10 denotes generally the first embodiment of the layer separator of the present invention. FIG. 1 is an illustration of the separator 10 in operation within a rectangular corrugated cardboard container 11 having top 12, bottom 13 and side walls 14. The separator 10 is generally rectangular in shape and is utilized to divide the spools 15 of yarn 16 into four courses or layers A, B, C and D.

The separator 10 comprises a first section 17 and a second section 18. The first section 17 is made from high impact, extruded ABS (acrylonitrile-butadiene-styrene) plastic and has a thickness ranging from 0.025 inches to 0.187 inches. A lip is formed about the periphery of section 17 and comprises an upright flange 19 terminating in arcuate portion 20 which has a depending outer wall 21 that terminates in bottom edge 22. The edge 22 should extend below second section 18. The inner surface 23 of side wall 21 has an inwardly tapering portion 24 adjacent bottom edge 22. It is preferred that the side wall 21 extend equally above and below the juncture of the first section 17 and second section 18 so as to distribute the applied side pressure equally as described hereinbelow.

In order to impart additional rigidity to separator 10, section 17 has an embossed top surface comprising a plurality of juxtaposed polygons, preferably hexagons 25 which form a honeycomb pattern. The hexagons 25 include an interior portion 26 and sides 27. The hexagons 25 are thermoformed into the section 17 such that interior portions 25 are raised an equidistant amount above sides 27.

Figure 3:
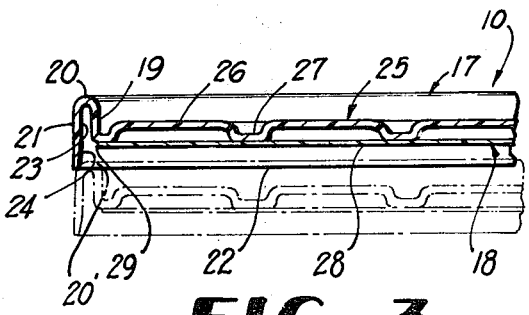
FIG. 3 is a view taken along lines 3—3 in FIG. 2.

The second section 18 is formed of the same plastic as the first section 17, namely, high impact, extruded ABS plastic having a thickness ranging from 0.010 to 0.125 inches and, as seen in FIG. 3, is bonded to the underside of each of the sides 27 by means of a conventional bonding composition for plastic. The bottom surface 28 of section 18 is flat. The outer edge 29 of section 18 is vertical and terminates beneath flange 19 so that there is a space between inner surface 23 and edge 29. The straight sides of section 17 are joined together by rounded corners 30 which aid in the placement of the separators 10 within the container 11 as discussed hereinbelow.

For ease in storage, FIG. 3 further shows that the separators 10 are nestable due to a tapering portion 24 which engages arcuate portion 20' of separator 10' shown in phantom lines beneath separator 10.

Figure 4:
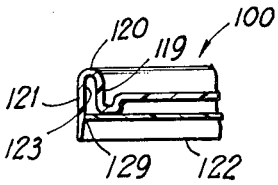
FIG. 4 is a sectional side view illustrating a second embodiment of the present invention.

A second embodiment of the separator is referred to in FIG. 4 by the numeral 100 and includes first section 117 and second section 118. Section 117 has flange 119, arcuate portion 120, and depending side wall 121 terminating in bottom edge 122 and having inner surface 123. The difference in the two embodiments of the separator 10 and 100 is that the outer edge 129 extends to and is in engagement with inner surface 123. The edge 129 may or may not be bonded to the inner surface 123.

In the operation of the present invention, a separator 10 is placed within a container 11 so that the straight sides of section 17 are parallel to the respective sides 14 of container 11 and so that the bottom edge 22 engages the bottom 13. A plurality of spools 15 of yarn 16 are vertically stacked on separator 10 within the confines of flange 19 so the bottoms of the spools 15 rest on the interior portions 26 of the hexagons 25 and form the first layer A. The flange 19 aids in retaining the outer spools 15 on the separator 10. A second separator 10 is placed within container 11 so that the bottom surface 28 of section 18 engages the tips of the spools 15 in the first layer A. The second section 18 thereby provides a smooth surface so that the tips of the spools 15 will not be damaged as well as providing for additional strength for separator 10.

The rounded corners 30 of the separator 10 allow air trapped beneath the separator 10 to be expelled as the separator 10 is placed into its respective position within the container 11 to aid in packing and unpacking the container 11. It is understood, of course, that other means could be utilized on separator 10 to allow the trapped air to escape instead of or in addition to rounded corners 30 such as providing concave-shaped indentations along the sides of the separator 10.

The above process is repeated to form layers B, C and D. A separator 10 may be placed on top of the spools 16 forming layer D to provide additional rigidity and support to the container 11 if a second similarily packed container 11 is stacked on the first container 11.

The pockets of air formed between the top of section 18 and the bottom of interior portions 23 aid in cushioning the spools 15.

In the specific application of the separator 10 illustrated in the figures of the drawing, the container 11 full of spools 15 of yarn 16 is moved about by means of material handling equipment which squeeze lift the container 11 by any of its opposed sides 14. The prior art cardboard separators had a tendency to buckle under the applied pressure. With the separator 10, the contents of the container 11 as well as the container 11 itself are protected because the design and construction of the separator 10 enables the separator 10 to continually withstand that applied pressure. As the pressure is applied to the sides 14 of the container 11, they transmit that pressure to side wall 21. Although the first section 17 is constructed of relatively hard or rigid plastic, nevertheless the side wall 21 is resilient under sufficient pressure. In the first embodiment, the space between inner surface 23 and edge 29 of second section 18 allows the side wall 21 to move inwardly slightly toward edge 29 and thereby absorb the pressure. Since the side wall 21 extends equally above and below the centerline of the separator 10, a balance is maintained to equalize the pressure on the separator 10.

In the second embodiment of separator 100 shown in FIG. 4, the side wall 121 is inflexible due to its engagement with edge 129. Thus, separator 100 is more rigid than separator 10 and is an alternative thereto.

The embossed surface of section 17 provides strength to separator 10, particularly when the surface is a honeycomb pattern formed of hexagons 25. The honeycomb configuration strengthens the resistance of separator 10 to bending and allows the separator 10 to be placed within container 11 without regard to any particular direction since there is no common fold-line across the surface of section 17. The same is true for separator 100.

Although the length and width of separator 10 may vary with the particular application, an illustrative example of the separator 10 has been constructed for a corrugated cardboard container having the dimensions 32 inches × 32 inches × 72 inches. Each hexagon 25 was $1\frac{1}{2}$ inches edge to edge and $1\frac{3}{4}$ inches point to point and was 1/16 inch deep. The width of sides 27 was $\frac{1}{4}$ inch. The depth of the sides 27 was 1/16 inch. The height of side wall 21 was $\frac{1}{2}$ inch and the distance between the inner surface 23 and edge 29 was $\frac{1}{2}$ inch. The bonding composition withstood 1700 lbs. of pressure exerted to separator 10. Corners 30 were formed with a 2 inch radius.

A separator 10 so constructed for a container 11 packed with spools 15 of yarn 16 as shown in FIG. 1 was shown to withstand squeeze lift pressure in excess of 1700 lbs. and vertical stacking pressure in excess of 1200 lbs. without any damage resulting to the container 11, the spools 15 or the yarn 16. The reduction in damage to containers 11 is important within the textile industry wherein the containers 11 are recycled, the cost of a container 11 being approximately $4.50. Since the separator 10 can be continually reused, its cost per use does not exceed and will usually be below the cost per use of the conventional cardboard separator which is usually discarded after one use. The fact that the separator 10 is constructed of plastic also reduces its cost per use since it may be easily cleaned by being washed with a hose or steam spray or the dirt may be blown off with compressed air, all without damage to separator 10.

What we claim is:

1. A separator for layers of items within a container to form at least first and second layers of same, comprising:

(a) a first section formed of plastic material having an embossed top surface wherein said first section includes an arcuate lip about its outer periphery, said lip including a depending side wall having an inner surface; and (b) a second section formed of plastic material and being joined to the underside of said first section and having an outer edge, said depending side wall extending beyond said outer edge.

2. A separator as claimed in claim 1 wherein said embossed top surface comprises a plurality of juxtaposed polygons.

3. A separator as claimed in claim 2 wherein said polygons are hexagons which form a honeycomb pattern.

4. A separator as claimed in claim 3 wherein the interior of each of said hexagons is equidistantly raised above said top surface.

5. A separator as claimed in claim 1 wherein said outer edge of said second section is spaced from said inner surface of said depending side wall.

6. A separator as claimed in claim 1 wherein said outer edge of said second section is in engagement with said inner surface of said depending side wall.

7. A separator as claimed in claim 1 wherein said plastic material is extruded ABS plastic having a thickness ranging from 0.025 inches to 0.187 inches in said first section.

8. A separator as claimed in claim 1 wherein said plastic material is extruded ABS plastic having a thickness ranging from 0.010 inches to 0.125 inches in said second section.

9. A separator as claimed in claim 1 wherein said container is rectangular and wherein said side wall is adjacent at least two opposed sides of said container.

10. A separator as claimed in claim 9 wherein said separator is substantially rectangular in shape and wherein the edges of said separator are rounded.

11. A separator to be horizontally interposed between layers of items within a container, comprising:

(a) a first section constructed of ABS plastic material having a first thickness and having a geometric design repetitively and uniformly formed thereon comprising a plurality of juxtaposed hexagons which form a honeycomb pattern; and, (b) a second section bonded to the underside of said first section and constructed of ABS plastic material having a second thickness which is less than said first thickness.

* * * * *